United States Patent [19]

Usab

[11] 3,993,214

[45] Nov. 23, 1976

[54] OPEN LIQUID SURFACE COVER

[75] Inventor: Martin A. Usab, Santa Ana, Calif.

[73] Assignee: Georg Fischer Aktiengesellschaft, Schaffhausen, Switzerland

[22] Filed: Aug. 25, 1975

[21] Appl. No.: 607,440

[52] U.S. Cl. ..... 220/218

[51] Int. Cl.[2] ..... B65D 87/18

[58] Field of Search ..... 220/88 A, 93, 216–227; 61/1 R, .5

[56] References Cited

UNITED STATES PATENTS

| | | | |
|---|---|---|---|
| 1,671,650 | 5/1928 | Newman et al. | 220/218 X |
| 2,920,648 | 1/1960 | Sheffer | 220/88 A X |
| 3,938,338 | 2/1976 | Cullen | 61/1 R |

FOREIGN PATENTS OR APPLICATIONS

| | | | |
|---|---|---|---|
| 840,214 | 4/1939 | France | 220/216 |
| 1,060,323 | 10/1956 | Germany | 220/216 |
| 833,325 | 3/1952 | Germany | 220/216 |

*Primary Examiner*—William Price
*Assistant Examiner*—Stephen Marcus
*Attorney, Agent, or Firm*—Philip M. Hinderstein

[57] ABSTRACT

Means for substantially reducing evaporation and heat loss from an open liquid surface comprising a plurality of pentagonal dodecahedrons which substantially cover the surface of the liquid. The dodecahedrons may be hollow or solid but are preferably made of structural foam having a specific gravity which is approximately one-half the specific gravity of the liquid.

20 Claims, 4 Drawing Figures

FIG. 1.
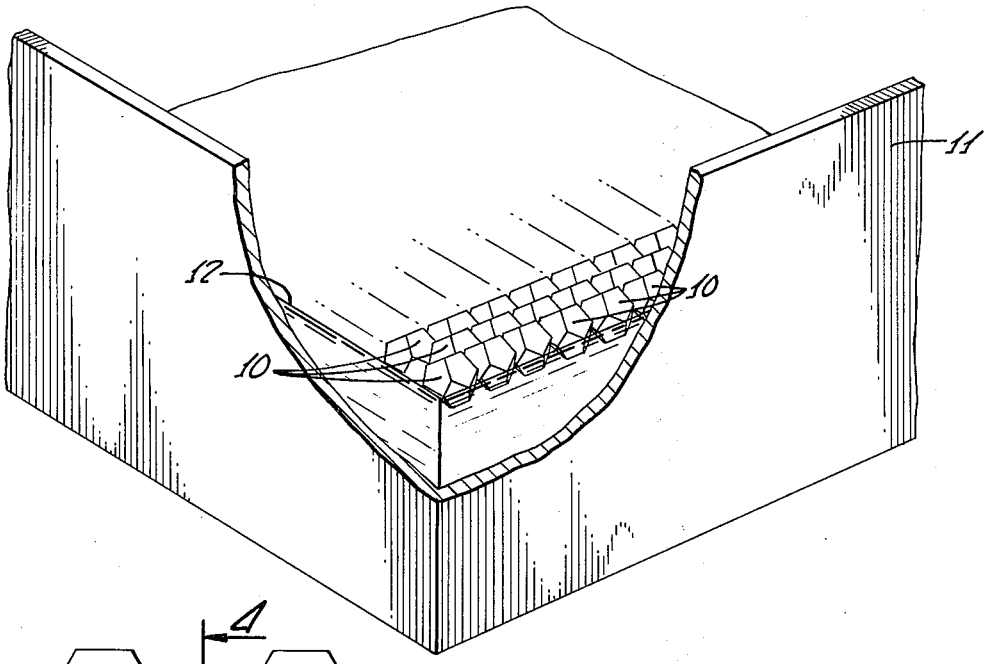
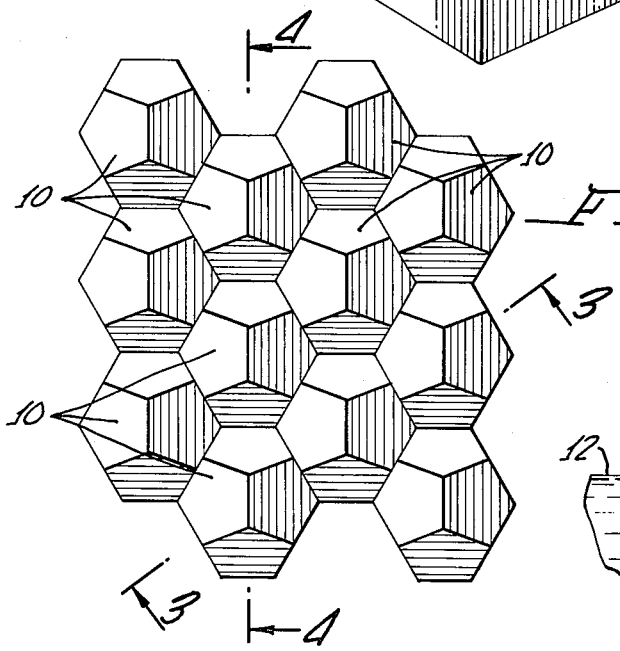
FIG. 2.
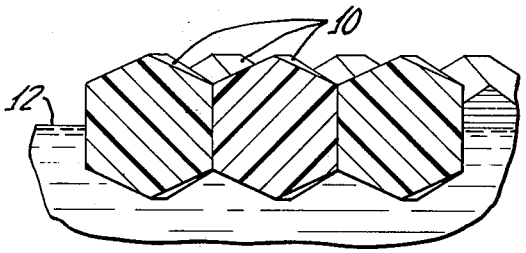
FIG. 3.
FIG. 4.
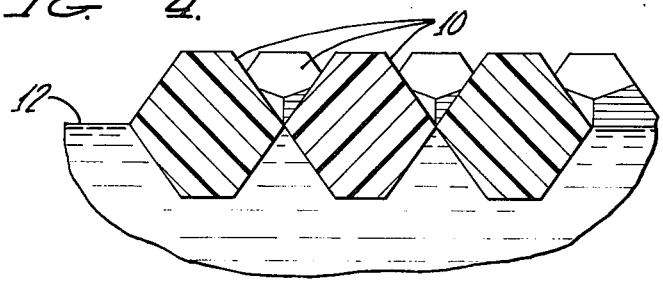

OPEN LIQUID SURFACE COVER

BACKGROUND OF THE INVENTION

1. Field of the Invention.

The present invention relates to an open liquid surface cover and, more particularly, to a highly efficient and economical float for substantially reducing evaporation and heat loss from an open liquid surface.

2. Description of the Prior Art.

May industries make use of open process tanks or utilize large open liquid surfaces. While a complete list of industrial activities utilizing open process tanks would be extensive, some of the more common examples are tanks used for plating, anodizing, acid pickling, dying, rinsing, phosphating, food processing, chemical treatment, galvanizing, degreasing, and the like. Other industrial applications utilize large liquid surfaces, such as in sewage treatment plants, waste oil pits, and the like.

Since it is essential in most of these applications to have unimpeded access to the liquid in the tank, the top of the tanks must remain open. However, this creates a wide variety of problems. Since such tanks are generally maintained at elevated temperatures, the most serious problems are those resulting from evaporation and heat loss. In addition, these tanks frequently produce unpleasant vapors which may be a hazard to health and corrode surrounding structures and equipment. Additional problems result from splashing of the liquid when various components are dipped into and removed from the tank and freezing of the liquid in cold weather.

The initial steps to overcome these problems were to use extractor fans to remove the vapors from a plant and to utilize protective clothing for the operators. However, these measures never got to the root of the problem, i.e. providing a cover for the open liquid surface.

Accordingly, the search for solutions to this problem has centered around developing a method which combines the heat conserving advantages of a solid lid and the easy accessibility of an open liquid surface. One proposed method is to cover the surface with a layer of oil, such as paraffin. However, the paraffin acts as an impurity, risking contamination of the liquid. The use of oil also represents a considerable fire hazard in many applications.

Another proposed solution is to use a foaming agent on the surface of the liquid. However, it is difficult to control the foam cover so that this process is expensive and the agent requires continual replenishment. While other surface agents have been proposed, they also present problems in control, require continual replenishment, and may interfere with the industrial process.

The most effective and simple solution to the problem of evaporation and heat loss and removal of fumes and odor has been to cover the surface of a liquid with a layer or blanket of floating objects of various shapes and sizes. For example, in German Pat. No. 1,060,323 a plurality of hollow, floating bodies are provided which have a foam structure incorporating a plurality of cavities, along with raised portions and trough-like depressions. However, these bodies suffer in two major respects. Due to their irregular shape, a substantial amount of evaporation losses are still present. Also, when the bodies are initially fed to the surface of the liquid, they tend to pile up upon one another rather than orienting themselves to cover the complete liquid surface. Also, when various components are removed from the tank, the bodies are displaced and move on to the top of adjacent bodies to form a pile, thus leaving a hole in the covering.

The most common body for use in these circumstances is a hollow sphere. A single layer of balls spread across the surface of a liquid will cover approximately 91 percent of the surface, thereby eliminating many of the disadvantages mentioned previously. When spheres are initially fed to the surface of the liquid, they readily orient themselves to cover the liquid surface. When components are inserted into and removed from the tank, the bodies readily reorient themselves. Thus, balls reduce evaporation, cut heat losses, substantially reduce fumes and odor, stop splashing, improve safety, and virtually eliminate contamination. The use of balls is less costly than various types of hinged lids in that the ball surface can be broken by an object immersed into the liquid and will reform to cover it.

On the other hand, several problems still remain with the use of hollow or solid spheres. For example, spheres rotate on the surface of the liquid so that the rotating ball carries some of the liquid above the cover of spheres. As a result, a substantial amount of evaporation still occurs. One proposed solution to this problem is disclosed in U.S. Pat. No. 3,401,818 which contemplates preventing the rotation of such spheres by the use of a circular bead of uniform thickness and radial width, the width and the weight of the bead being such that the spheres are prevented from rotating on the liquid. Another approach is to use a triangular-shaped fin extending radially outwardly to form a weight which prevents rotation of the spheres. While this reduces evaporation, the method still suffers from the fact that one layer of balls covers only approximately 91 percent of the liquid surface. Thus, 9 percent of the surface is still open for evaporation and heat loss and in many applications this is unacceptable. Accordingly, it is common to use one or more additional layers of balls in an attempt to substantially cover the surface. However, this is simply not possible with spheres, which do not nest in a manner which permits a substantially complete cover.

SUMMARY OF THE INVENTION

According to the present invention, there is provided an open liquid surface cover including a plurality of floating bodies which substantially eliminates all of the above disadvantages while permitting a uniform covering of a liquid surface, unimpeded access to such liquid, and an increased prevention of evaporation and heat loss. The present cover provides a theoretical 100 percent surface covering and, in practice, this theoretical 100 percent cover is substantially achieved. The present bodies will not rotate, even in the presence of turbulent liquids, thereby preventing presentation of the liquid to the atmosphere and evaporation and heat loss. This is achieved with a single layer of bodies so that the increased efficiency is achieved at a much greater economy. The present floating bodies are designed to rest with the fluid surface on the equator, thereby sealing at the surface instead of at the small diameter of hollow spheres. The present bodies are preferably solid, thereby having many times the compressive strength of hollow balls. Further, the present bodies are less subject to the thermal stresses of higher temperature fluids.

Briefly, the present cover comprises a plurality of floating dodecahedrons which substantially cover the surface of the liquid. The dodecahedrons may be hollow or solid, but are preferably made of structural foam having a specific gravity which is approximately one-half the specific gravity of the liquid. Each dodecahedron includes twelve identical pentagonal faces.

OBJECTS

It is therefore an object of the present invention to provided an open liquid surface cover.

It is a further object of the present invention to provide a highly efficient and economical float for substantially reducing evaporation and heat loss from an open liquid surface.

It is a still further object of the present invention to provide an open liquid surface cover comprising a plurality of floating dodecahedrons.

It is another object of the present invention to provide an open liquid surface cover comprising a plurality of dodecahedrons made from structural foam.

It is still another object of the present invention to provide an open liquid surface cover comprising a plurality of solid dodecahedrons having a specific gravity which is approximately one-half that of water.

Another object of the present invention is the provision of an open liquid surface cover comprising a plurality of bodies where a single layer of such bodies will essentially provide a 100 percent surface cover.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 1 is a perspective view, partly in section, of an open process tank including a cover constructed in accordance with the teachings of the present invention;

FIG. 2 is an enlarged, top plan view of a portion of the cover of FIG. 1; and FIGS. 3 and 4 are sectional views taken along the lines 3—3 and 4—4, respectively, in FIG. 2.

DESCRIPTION OF THE PREFERRED EMBODIMENT

Referring now to the drawings, the present means for providing an open liquid surface cover comprises a plurality of dodecahedrons 10, each dodecahedron 10 having twelve identical pentagonal faces. When placed in a tank 11 or other vessel having an open liquid surface 12, dodecahedrons 10 substantially cover surface 12. That is, while the different surfaces and edges of each dodecahedron 10 may make line-to-line, line-to-surface, or surface-to-surface contact with adjacent dodecahedrons 10, as seen in FIGS. 2–4, it has been experimentally verified that the nature of a pentagonal dodecahedron is such that a plurality of dodecahedrons automatically arrange themselves to theoretically cover 100 percent of the liquid surface. In a large area of covered surface, there may be certain discontinuities of the regular pattern due to a lack of absolute perfection in the shape and size of bodies 10. This break in the ultra-uniform pattern will appear to be greater than it is because of the optical magnification of the deviation.

However, where there are sufficient bodies 10 to cover surface 12, it has been observed and measured that there is normally considerably less than a 1 percent open surface caused by these imperfections. Thus, a single layer of dodecahedrons 10 will serve the purpose of providing better than 99 percent coverage, which could only be obtained by multiple layers of spheres or other bodies. Thus, dodecahedrons provide better efficiency than a multilayer application of spheres, providing a much greater economy. Furthermore, if a second layer of dodecahedrons 10 are superimposed over the first layer, they will automatically align themselves in close geometric juxtaposition to effectively eliminate any open area exposed to the atmosphere.

Dodecahedrons 10 may be hollow, as is the case with conventional hollow balls, but must be made from a material which is resistant to corrosive solutions and which can withstand high temperatures. Preferably, dodecahedrons 10 are made from polypropylene, structural foam, because it is a low cost, low density material which floats, is highly corrosion resistant, and heat resistant. Furthermore, a solid body has many times the compressive strength of a hollow body and is less subject to the thermal stresses of a higher temperature fluid. Dodecahedrons 10 may be of any diameter suitable for the particular application.

Another unique advantage of a dodecahedron is that it seeks a natural seating with adjacent bodies. Thus, any turbulence, vibration, or agitation of liquid surface 12 will tend to cause more, rather than less, precise alignment, guaranteeing the maximum coverage of surface 12.

Because of the tendency of dodecahedrons 10 to form an essentially complete cover over surface 12, dodecahedrons 10 will not normally rotate. Even turbulent liquids will not cause rotation of dodecahedrons 10, thereby eliminating the presentation of the liquid to the atomosphere with resultant evaporation and heat loss.

According to the preferred embodiment of the present invention, dodecahedrons 10 have a specific gravity which is approximately one-half the specific gravity of the liquid in tank 11. Since the specific gravity of most liquids is slightly greater than that of water, i.e. 1.0, the preferable specific gravity for dodecahedrons 10 is 0.55. With such a specific gravity, each dodecahedron 10 will float with liquid surface 12 on the "equator" so that surface 12 is completely covered. This further eliminates any tendency for dodecahedrons 10 to rotate.

In operation, it is simply necessary to dump a plurality of dodecahedrons 10 into tank 11, whereupon the floating dodecahedrons 10 disperse themselves over surface 12. Any turbulence, vibration, or agitation of liquid surface 12 will cause dodecahedrons 10 to automatically align themselves into a position providing a better than 99% cover for surface 12, assuming a sufficient number of dodecahedrons 10 are provided.

Doedecahedrons 10 may be produced in any size required for their function, in a broad range of densities, of many materials, and with a variety of chemical, thermal, and mechanical properties. Colors may be used to reflect or absorb light and heat. Composites of two or more materials may be used to vary densities, properties, or cost. The surfaces of dodecahedrons 10 may be coated by various means to provide protection of the fluid or the bodies. A special surface may be used to induce a catalytic reaction or, to inhibit a reaction.

In general, dodecahedrons 10 may be used to perform all of the functions of the well-known hollow, spherical devices, or any of the other known devices, but with a vastly improved efficiency and at a generally lower cost due to the minimum number required.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only the by the scope of the appended claims.

I claim:

1. In combination, a tank containing liquid and a plurality of dodecahedrons floating on the surface of said liquid and substantially covering same, each of said dodecahedrons including twelve identical pentagonal faces, some of the edges of said dodecahedrons making contact with adjacent edges of adjacent dodecahedrons, others of the edges of said dodecahedrons making contact with adjacent surface of adjacent dodecahedrons, and some of the surfaces of said dodecahedrons making contact with adjacent surfaces of adjacent dodecahedrons.

2. The combination of claim 1 wherein said dodecahedrons are solid.

3. The combination of claim 2 wherein said dodecahedrons are uniform in density.

4. The combination of claim 2 wherein said dodecahedrons are made of structural foam.

5. The combination of claim 4 wherein the specific gravity of said foam is approximately one-half the specific gravity of said liquid.

6. In a system for covering a body of liquid wherein a plurality of bodies are floated on the surface of the liquid to substantially cover same, the improvement wherein each of said bodies is a dodecahedron having twelve identical pentagonal faces.

7. In a system according to claim 6, the improvement wherein each of said dodecahedrons is solid.

8. In a system according to claim 7, the improvement wherein each of said dodecahedrons is unweighted.

9. In a system according to claim 7, the improvement wherein each of said dodecahedrons is made of structural foam.

10. In a system according to claim 9, the improvement wherein the specific gravity of said foam is approximately one-half the specific gravity of said liquid.

11. A float for use in preventing contact between air and liquid comprising:

a pentagonal dodecahedron, a plurality of said dodecahedrons being adapted to float on the surface of said liquid.

12. A float according to claim 11 wherein said dodecahedron is free of any weighting member tending to cause a specific orientation when floating on said surface of said liquid.

13. A float according to claim 11 wherein said dodecahedron is solid.

14. A float according to claim 13 wherein said dodecahedron is made of structural foam.

15. A float according to claim 14 wherein the specific gravity of said foam is approximately one-half the specific gravity of said liquid.

16. Means for preventing the evaporation of liquid from the surface thereof comprising:

a plurality of pentagonal dodecahedrons floating on and substantially covering said surface of said liquid, different ones of the surfaces and edges of each of said dodecahedrons making edge-to-edge, edge-to-surface, or surface-to-surface contact with adjacent dodecahedrons.

17. Means for preventing the evaporation of liquid according to claim 16 wherein said dodecahedrons are uniform in density.

18. Means for preventing the evaporation of liquid according to claim 16 wherein said dodecahedrons are solid.

19. Means for preventing the evaporation of liquid according to claim 18 wherein said dodecahedrons are made of structural foam.

20. Means for preventing the evaporation of liquid according to claim 19 wherein the specific gravity of said foam is approximately one-half the specific gravity of said liquid.

* * * * *